US009222212B2

(12) United States Patent
Johansson

(10) Patent No.: US 9,222,212 B2
(45) Date of Patent: Dec. 29, 2015

(54) METHOD FOR PROCESSING LAUNDRY, AND A LAUNDRY PROCESSING DEVICE

(75) Inventor: Mattias Johansson, Ljungby (SE)

(73) Assignee: AKTIEBOLAGET ELECTROLUX, Stockholm (SE)

( * ) Notice: Subject to any disclaimer, the term of this patent is extended or adjusted under 35 U.S.C. 154(b) by 1264 days.

(21) Appl. No.: 12/922,032

(22) PCT Filed: Mar. 7, 2009

(86) PCT No.: PCT/EP2009/001666
§ 371 (c)(1),
(2), (4) Date: Dec. 7, 2010

(87) PCT Pub. No.: WO2009/112222
PCT Pub. Date: Sep. 17, 2009

(65) Prior Publication Data

US 2011/0067186 A1 Mar. 24, 2011

(30) Foreign Application Priority Data

Mar. 11, 2008 (SE) ..... 0800554

(51) Int. Cl.
*D06F 58/28* (2006.01)
*D06F 35/00* (2006.01)
(Continued)

(52) U.S. Cl.
CPC ..... *D06F 58/28* (2013.01); *D06F 35/006* (2013.01); *D06F 37/203* (2013.01); *D06F 39/003* (2013.01); *D06F 2202/065* (2013.01); *D06F 2202/10* (2013.01); *D06F 2204/065* (2013.01); *D06F 2222/00* (2013.01)

(58) Field of Classification Search
CPC ... D06F 35/006; D06F 37/203; D06F 39/003; D06F 2202/065; D06F 2202/10; D06F 2204/065; D06F 2222/00; D06F 58/28
USPC ..... 8/158, 159; 68/12.06, 23.1, 23.2, 24
See application file for complete search history.

(56) References Cited

U.S. PATENT DOCUMENTS

| | | | | |
|---|---|---|---|---|
| 4,765,161 | A * | 8/1988 | Williamson | 68/12.06 |
| 6,029,300 | A * | 2/2000 | Kawaguchi et al. | 8/159 |
| 8,151,393 | B2 * | 4/2012 | Bae et al. | 8/159 |

(Continued)

FOREIGN PATENT DOCUMENTS

| | | |
|---|---|---|
| EP | 0 110 999 A | 6/1994 |
| EP | 1 609 901 A | 12/2005 |

(Continued)

OTHER PUBLICATIONS

International Search Report for PCT/EP2009/001666 dated Jul. 13, 2009.

*Primary Examiner* — Joseph L Perrin
(74) *Attorney, Agent, or Firm* — Pearne & Gordon LLP

(57) ABSTRACT

The invention relates to a method for processing laundry in a laundry processing device (110) comprising a drum (112) that is rotatably mounted on a support so as to be rotated about a substantially horizontal axis. The method comprises recording, while the laundry is being processed, a signal that is correlated to the interaction between the drum (112) and the laundry (114), and that exhibits a variation caused by the rotation of the drum (112); on the basis of the signal and a desired process result, determining a target rotary speed of the drum (112); and adjusting the rotary speed of the drum (112) to the target rotary speed. Further, the invention relates to a laundry processing device capable of performing the method.

6 Claims, 7 Drawing Sheets

(51) Int. Cl.
*D06F 37/20* (2006.01)
*D06F 39/00* (2006.01)

(56) References Cited

U.S. PATENT DOCUMENTS 8,220,093 B2 * 7/2012 Bae et al. ..... 8/159
8,302,232 B2 * 11/2012 Bae et al. ..... 8/159
8,365,334 B2 * 2/2013 Bae et al. ..... 8/159
2001/0049846 A1 * 12/2001 Guzzi et al. ..... 8/158
2002/0016997 A1 2/2002 Jonsson
2005/0284192 A1 * 12/2005 Altinier et al. ..... 68/12.06

FOREIGN PATENT DOCUMENTS

EP 1 783 261 A 5/2007
JP 06 254286 A 9/1994

* cited by examiner

METHOD FOR PROCESSING LAUNDRY, AND A LAUNDRY PROCESSING DEVICE

FIELD OF THE INVENTION

The present invention relates to a method for processing laundry in a laundry processing device, the device comprising a drum, adapted to accommodate laundry and being rotatably mounted on a support so as to be rotated about a substantially horizontal axis; a motor, adapted for rotating the drum; and a controller, adapted for controlling the rotary speed of the drum. The invention further relates to a laundry processing device adapted to perform such a method.

BACKGROUND OF THE INVENTION

Processing of laundry is, in this disclosure, defined as any action performed on laundry so as to change the properties of the laundry itself, e.g. soaking, dissolving and removal of dirt, removal of water and/or detergent from the laundry, changing the compactness or level of creasing of the laundry, etc. Some laundry processing devices, e.g. washing machines, tumble dryers and combined washing machines/dryers, generally operate by processing the laundry in a rotatable drum. The drum is rotated according to a particular program, which can be selected by the user. Typically, a washing machine following a washing program performs a number of functions, including soaking, washing, rinsing, spin-drying, and detachment/de-compacting, each function having its own process parameters with respect to washing fluid level, concentration and type of detergent, washing fluid temperature, rotary speed of the drum etc. The washing fluid may be, for example, water or $CO_2$ in liquid or supercritical phase. A tumble dryer normally follows a simpler program, merely rotating the drum and periodically changing its direction of rotation.

As there is a widespread and increasing awareness of environmental issues in society, there is a demand for more efficient laundry processing devices with respect to washing fluid, detergent and energy consumption. However, simply reducing the amount of washing fluid in a washing machine or shortening the operating time of a washing machine or a tumble dryer will merely result in the laundry not being properly cleaned, or dried, respectively. There is thus a strong need for more efficient laundry processing devices and methods.

SUMMARY OF THE INVENTION

It is an object of the present invention to provide a more efficient laundry processing method, as well as a laundry processing device with improved performance. With the foregoing and other objects in view, there is provided a method for processing laundry in a laundry processing device, the device comprising a drum, adapted to accommodate laundry and being rotatably mounted on a support so as to be rotated about a substantially horizontal axis; a motor, arranged for rotating the drum; and a controller, adapted for controlling the rotary speed of the drum. The method comprises initiating, when the drum contains laundry, a rotation of the drum by means of the motor; recording, while the laundry is being processed, a signal that is correlated to the interaction between the drum and the laundry, and that exhibits a variation caused by the rotation of the drum. In the following, such a signal shall be referred to as a laundry-drum interaction signal. The method further comprises determining a target rotary speed of the drum on the basis of the signal and a desired process result; and adjusting the rotary speed of the drum to the target rotary speed.

Using this method, it is possible to obtain an optimized drum speed, which may result in a more efficient laundry processing.

In one embodiment, the target rotary speed is selected based on a desired level of mechanical action on the laundry. Using this method, it is possible to find a rotary speed of the drum at which the laundry will be subjected to a desired level of mechanical action. And thanks to the ability to set a desired level of mechanical action, it is possible to optimize the mechanical action on the laundry in any laundry processing programme. This enables a more efficient laundry processing.

In one embodiment, the target rotary speed is kept below a speed that yields a maximum of allowed mechanical action on the laundry. Using this method, it is possible to maximize the mechanical action on the laundry in a delicate fabrics laundry processing program, while staying within specified maximum tolerances of both the laundry and of the machine itself. This in turn may, e.g., enable achieving cleaner laundry in a shorter time, consuming less energy than existing methods.

Should the integrated, total amount of mechanical action during a laundry processing program reach a maximum total amount of mechanical action, it is also possible to interrupt the laundry processing program earlier.

In one embodiment, the target rotary speed is determined such that, at the target rotary speed, the laundry will not drop through the drum. In some laundry processing programs it is desired to expose the laundry to a very low mechanical action. This is particularly true in, e.g., a wool program. Keeping the laundry from dropping will limit the level of mechanical action that the laundry is exposed to.

In one embodiment, the target rotary speed is selected such that the laundry will drop through the drum. This will guarantee a strong mechanical action on the laundry.

In one embodiment, the target rotary speed is selected to be within a rotary speed interval of from 75% to 120% of a rotary speed that corresponds to a maximum of the laundry drop height. By ensuring that the rotary speed of the drum is within this interval, it is also ensured that the mechanical action on the laundry will be near its maximum. Preferably, the target rotary speed is the rotary speed that maximizes the laundry drop height. In the case of a washing machine, this rotary speed produces the strongest impact between the laundry and the drum, thereby increasing the cleaning efficiency. In the case of a tumble dryer, this rotary speed maximizes the time that the laundry stays in the air, thereby reducing the drying time.

Consequently, in the case of a tumble dryer, the drying process will be faster, and in the case of a washing machine, the washing process will be more efficient, respectively, than in a conventional machine.

In one embodiment, the laundry processing device further comprises a drain valve; and the method is performed while the drain valve is closed and the drum contains a level of washing fluid.

In one embodiment, the laundry processing device is a tumble dryer.

The invention may also be employed to detect when the laundry has been sufficiently detached from the drum in the detachment/de-compacting cycle. The target rotary speed may therefore, evidently, be zero, should the detachment and de-compacting be found to be sufficient.

In one embodiment, the signal is correlated to the static unbalance mass m. When the static unbalance mass is below a threshold value, it is reasonable to assume that all laundry has detached from the drum and is being de-compacted.

In one embodiment, the signal is correlated to the movement of the laundry inside the drum. By detecting, e.g., when the amount of laundry that moves inside the drum does not increase any further, it is reasonable to assume that all laundry has detached from the drum and is being de-compacted.

In one embodiment, the target rotary speed of the drum is determined on the basis of the location, velocity, or impact acceleration of the drum or of any structure connected to the drum. This embodiment is particularly simple to implement, e.g. with an accelerometer, and typically provides a good signal strength.

In one embodiment, the target rotary speed of the drum is determined on the basis of the force exerted by the drum on a structure supporting the drum. Also this embodiment is particularly simple to implement, e.g. with a load cell, and typically provides a good signal strength.

In one embodiment, the target rotary speed of the drum is determined on the basis of the elevation torque.

In one embodiment, the target rotary speed of the drum is determined on the basis of at least one of the following: the weight of the drum; the signal from a microphone; the signal from a pressure sensor sensing the pressure of any washing fluid in the drum; the signal from a camera.

The target rotary speed may, of course, also be determined on the basis of any combination of the bases mentioned above. Similarly, sets of features from different embodiments may be combined so as to improve total processing efficiency.

According to another aspect of the invention, there is provided a laundry processing device comprising a drum, adapted to accommodate laundry and being rotatably mounted on a support so as to be rotated about a substantially horizontal axis; a motor, arranged for rotating the drum; a controller, adapted for controlling the rotary speed of the drum; means arranged and configured for recording, while the laundry is being processed, a signal that is correlated to the interaction between the drum and the laundry, and that exhibits a variation caused by the rotation of the drum; means arranged and configured for determining, on the basis of the signal and a desired process result, a target rotary speed of the drum.

In one embodiment, the laundry processing device is configured and arranged select the target rotary speed based on a desired level of mechanical action on the laundry.

In one embodiment, the laundry processing device is configured and arranged select the target rotary speed based on a desired maximum level of mechanical action on the laundry.

In one embodiment, the target rotary speed is determined such that, at the target rotary speed, the laundry will not drop through the drum.

In one embodiment, the laundry processing device is configured and arranged to select the target rotary speed within a rotary speed interval of from 75% to 120% of a rotary speed that corresponds to a maximum of the laundry drop height.

In one embodiment, the laundry processing device further comprises a drain valve, and is configured and arranged to adjust the speed of the drum to the target rotary speed while the drain valve is closed and the drum contains a level of washing fluid.

In one embodiment, the signal is correlated to at least one of the following: the movement of the laundry inside the drum; the static unbalance mass of the drum and the laundry In one embodiment, the laundry processing device is configured and arranged to select the target rotary speed based on a desired maximum level of mechanical action on the laundry.

In one embodiment, the means for recording a signal is arranged and configured to measure the elevation torque.

In one embodiment, the means for recording a signal comprises means for measuring the angular position of the drum and means for measuring the torque provided by the motor. Preferably, the means for measuring the angular position of the drum comprises a Hall detector arranged and configured for measuring the position of the motor. Preferably, the means for measuring the torque comprises a current sensor arranged and configured for measuring an electrical current provided to the motor.

In one embodiment, the means for recording a signal is arranged and configured for measuring the impact between the laundry and the inner surface of the drum.

In one embodiment, the means for recording a signal comprises a position sensor. The position sensor may be based on e.g. optical interferometry, Hall effect sensors, potentiometers, or any other electrical, optical, or mechanical means.

In one embodiment, the means for recording a signal comprises a speed sensor. The speed sensor may be based on e.g. the Doppler shift of any electromagnetic or acoustic wave reflected from the drum or any structure connected to the drum.

In one embodiment, the means for recording a signal comprises an accelerometer.

In one embodiment, the means for recording a signal comprises a load cell. Preferably, the load cell comprises a strain gauge or a piezoelectric element.

In one embodiment, the means for recording a signal comprises a microphone. In one embodiment, the means for recording a signal comprises a pressure sensor configured for measuring the pressure of any washing fluid. In one embodiment, the means for recording a signal comprises a camera. In one embodiment, the means for recording a signal comprises means for weighing the drum.

Naturally, the recording means of further embodiments may comprise any combination of the sensing means mentioned above.

In one embodiment, the laundry processing device is a washing machine. In another embodiment, the laundry processing device is a tumble dryer. In yet another embodiment, the laundry processing device is a combined washing machine and tumble dryer.

Thanks to the more efficient laundry processing provided by the invention it is possible to shorten laundry processing times, lower laundry processing temperatures, and/or saving washing fluid and/or detergent. All those benefits contribute to minimizing energy consumption, operation cost and impact on the environment.

DETAILED DESCRIPTION OF THE EXEMPLARY EMBODIMENTS

Figure 1:
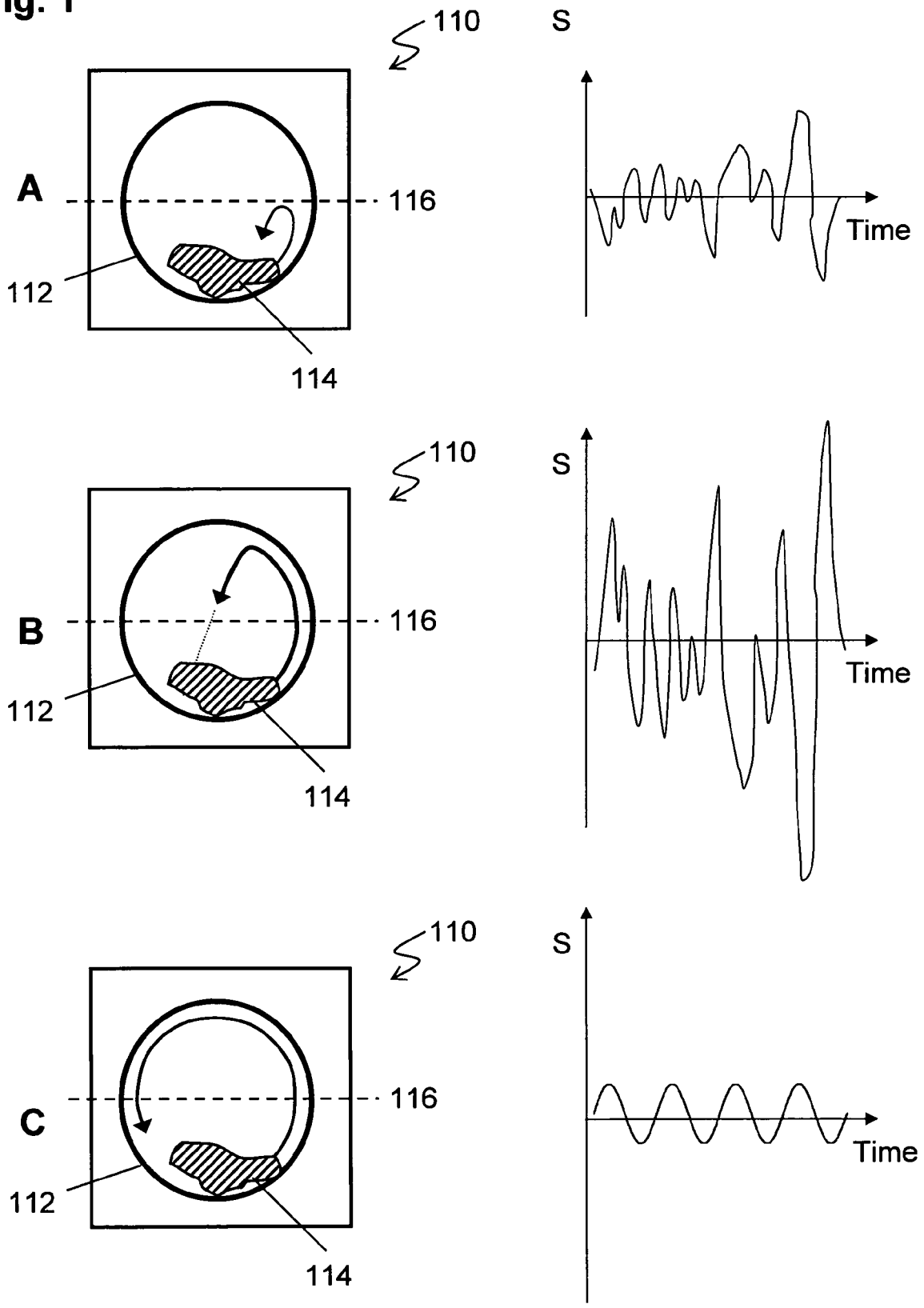
FIG. 1 is a set of schematic front views of a laundry processing device, illustrating different scenarios of laundry motion inside the drum. Adjacent to each instance of the device, a respective graph illustrates a corresponding laundry-drum interaction signal.

FIG. 1 shows, at three different occasions, a laundry processing device 110, having a drum 112 comprising a set of laundry 114. The drum is arranged to be rotated by a motor. Depending on the rotary speed of the drum 112, three different scenarios may occur, each of which is illustrated in FIG. 1. A graph corresponding to each instance of the laundry processing device 110 (for illustration purpose only) illustrates the signal S, as a function of time, from an imagined accelerometer mounted on the device 110.

Depending on the rotary speed, the laundry 114 will

A. roll over itself on the inner surface of the drum 112, i.e. the centrifugal force is not strong enough to lift the laundry 114 above the centreline 116 of the drum 112;

B. leave the inner surface of the inner drum 112 and fall freely through the drum 112, into any washing fluid/detergent if applicable, and hit the bottom of the drum 112; i.e. the centrifugal force is strong enough to lift the laundry 114 above the centreline 116 of the drum 112 but weaker than the gravity; or C. complete the revolutions stuck to the inner surface of the drum 112, i.e. the centrifugal force is stronger than the gravity.

In scenario B, the laundry's 114 trajectory through the drum 112 depends on the rotary speed of the drum 112. Consequently, by varying the rotary speed of the drum 112 within the speed boundaries limiting regime B above, it is possible to vary the mechanical action to which the laundry 114 is exposed.

Figure 2A:
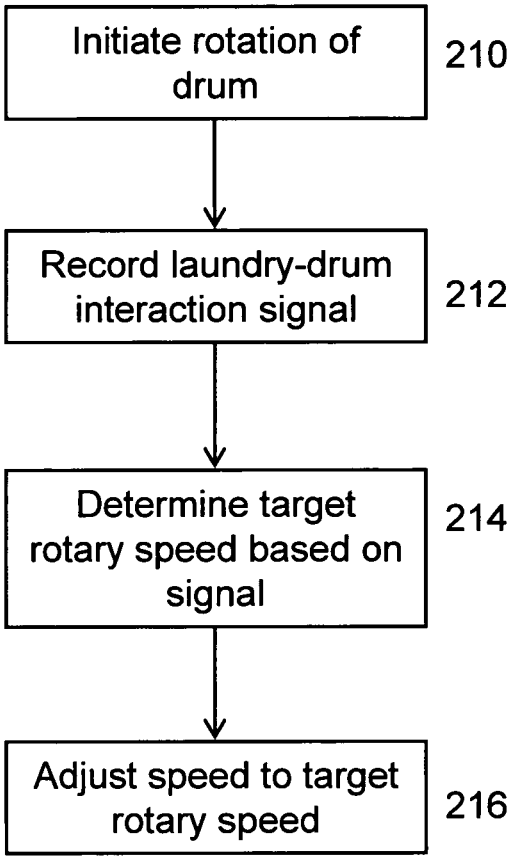
FIG. 2A is a flow chart, illustrating an embodiment of a method for controlling a laundry processing device.

FIG. 2A shows an example of a laundry processing method suitable for the laundry processing device of FIG. 1.

In step 210, the drum 112 is loaded with laundry 114 and a rotation of the drum 112 is initiated by means of the motor.

In step 212, a signal that is correlated to the interaction between the drum 112 and the laundry 114, and that exhibits a variation caused by the rotation of the drum 112, is recorded while the laundry is being processed.

In step 214, a target rotary speed of the drum 112 is determined on the basis of the signal and a desired process result.

In step 216, the rotary speed of the drum 112 is adjusted to the target rotary speed.

The laundry processing device and method described above with reference to FIGS. 1-2 may be implemented in many different embodiments. For example, the laundry processing device 110 may be a washing machine, a tumble dryer, or a combined washing machine and tumble dryer.

Figure 2B:
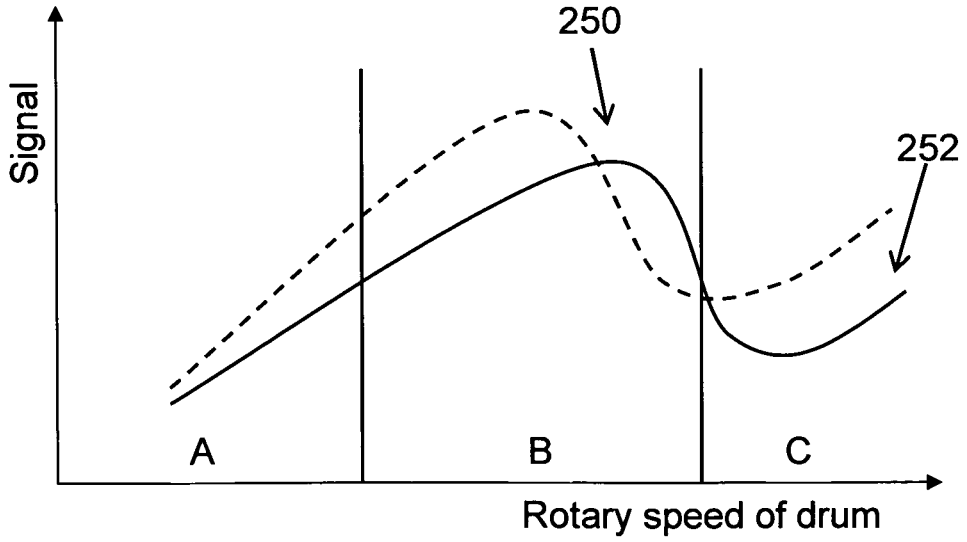
FIG. 2B is a graph, illustrating examples of the general shape of a signal related to the interaction between laundry and a drum.

FIG. 2B illustrates an example of a general shape of a signal that exhibits a variation caused by rotation of the drum 112, and that is correlated to the interaction between the laundry 114 and the drum 112. This particular example shows the shape when using an accelerometer for obtaining a laundry-drum interaction signal, and the drum speed intervals corresponding to scenarios A-C described above with reference to FIG. 1 are indicated in relation to the solid curve in FIG. 2. The solid curve features a local maximum 250, corresponding to a maximum of the laundry drop height; any static unbalance mass, i.e. unbalanced laundry load, will however make the signal level rise again at higher speeds, as indicated by 252. The location of the curve along the axes as well as the location of the peak will vary depending on e.g. the type and amount of laundry in the drum, any amount of washing fluid in the drum, any level of soaking of the laundry etc, as is illustrated by the dashed curve, but the general shape will essentially remain the same. Most sensors measuring the position of, or forces acting on the drum, will provide a signal having this general shape.

Also other signal behaviours than the one illustrated in FIG. 2B may, depending on the laundry processing device, laundry processing conditions, and type of measurement means, occur, and are within the scope of the appended claims.

Figure 3A:
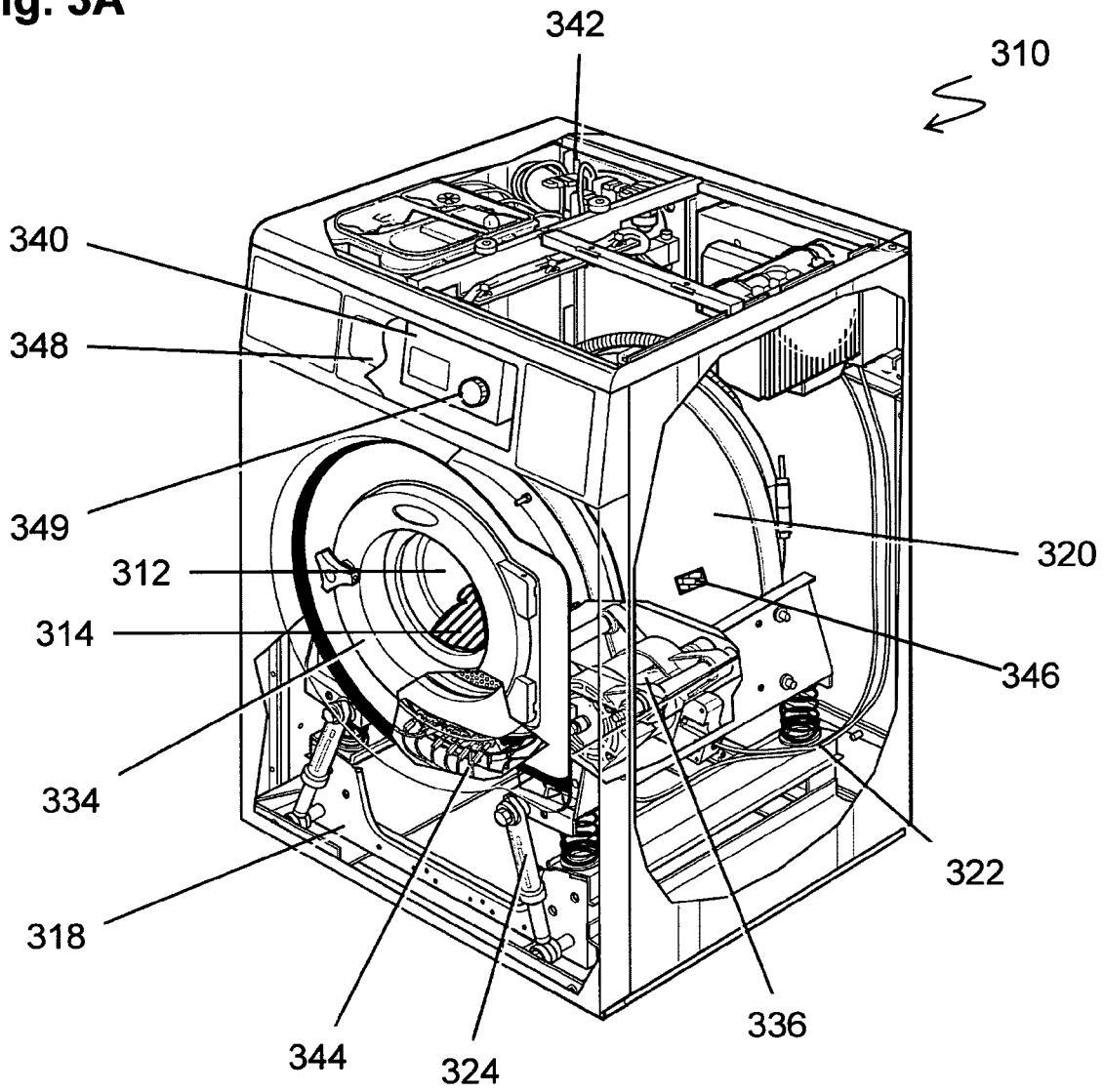
FIG. 3A is a perspective view, with parts broken away, of a washing machine.

FIG. 3A shows another exemplary embodiment of a laundry processing device, and more specifically of a washing machine 310 adapted for washing of textiles 314 using water and detergent. The washing machine 310 in the figure has a frame 318, in which a cylindrical outer drum 320 is resiliently mounted on springs 322 and shock absorbers 324. Inside the outer drum 320, a cylindrical, perforated inner drum 312 is rotateably arranged and journalled in a support on the back surface of the outer drum 320. A drum shaft, arranged for rotation of the inner drum 312, penetrates the back wall of the outer drum 320 via a water-tight, rotary joint.

Laundry 314 may be loaded into the inner drum 312 of the washing machine 310 by means of openings in the front of the outer and inner drums 320, 312, respectively. The outer drum 320 is provided with a door 334, which seals the outer drum 320 from the world outside in a watertight manner. The outer drum 320 thus defines a watertight compartment, inside which there is an inner drum 312 that is rotatable from outside of the outer drum 320 via a pulley on the drum shaft. A brushless electric motor 336 is connected to the drum shaft via a drive belt, and the motor 336 is controlled by a controller 340.

A supply valve 342, connected to a water supply, is arranged to fill the outer drum 320, and consequently the perforated inner drum 312, with water up to a suitable level at the beginning of each washing or rinsing operation. At the end of each operation, the drums 320, 312 are drained by means of a drain valve 344. Both valves are connected to and operated by the controller 340.

An accelerometer 346, arranged to measure the impact acceleration of the outer drum 320 as the laundry 314 hits the surface of the washing fluid or the bottom of the inner drum 312, is attached to the outer surface of the outer drum 320. The accelerometer 346 may, by way of example, be a three-axis MEMS-type (Microelectromechanical System) capacitive accelerometer. It is arranged to deliver a signal corresponding to an impact acceleration to which the outer drum 320 is exposed as the laundry 314 hits the surface of the washing fluid or the bottom of the inner drum, the use of which impact acceleration signal will be further explained below with reference to FIGS. 4A-B.

The location of the accelerometer 346 indicated in the figure is only an example; the accelerometer 346 may in fact be attached to any part of the spring-suspended portion of the machine, such as any other surface of the outer drum, or any structure connecting the outer drum to the suspension.

Figure 3B:
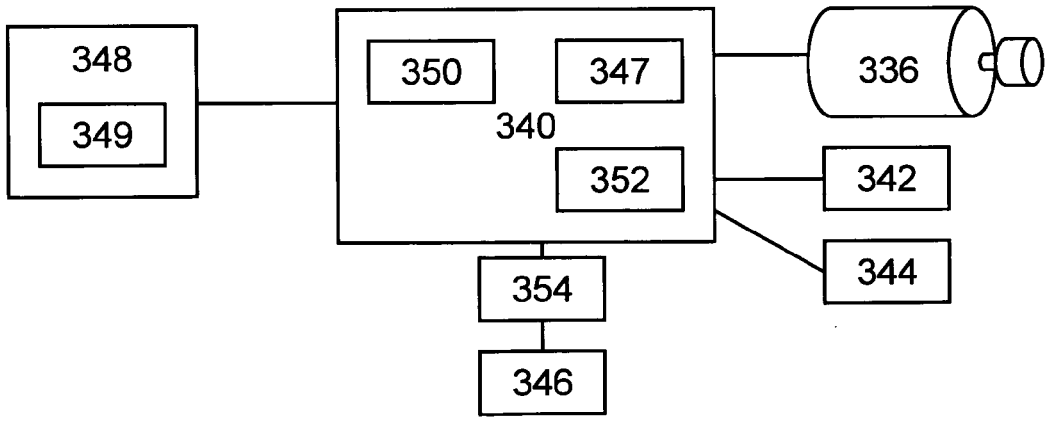
FIG. 3B is a schematic drawing of a control system for controlling the washing machine in FIG. 3A.

FIG. 3B shows the control system in greater detail. The controller 340 comprises a processor 347, and a working memory 352 having storage positions for laundry-drum interaction signals as well as variables needed during operation. Further, the controller 340 is connected to an input panel 348, which is provided with user input buttons and a program selector 349. Via the input panel 348, a user can select and start one of several predefined washing programmes stored in a washing program memory 350. Moreover, the controller is arranged to control a drive current to the motor 336, and to receive a feed-back signal from the motor 336, indicating its speed.

The controller 340 is also connected to the supply and drain valves 342, 344, and via a signal processing device 354 for filtering the accelerometer signal, to the accelerometer 346.

Figure 4A:
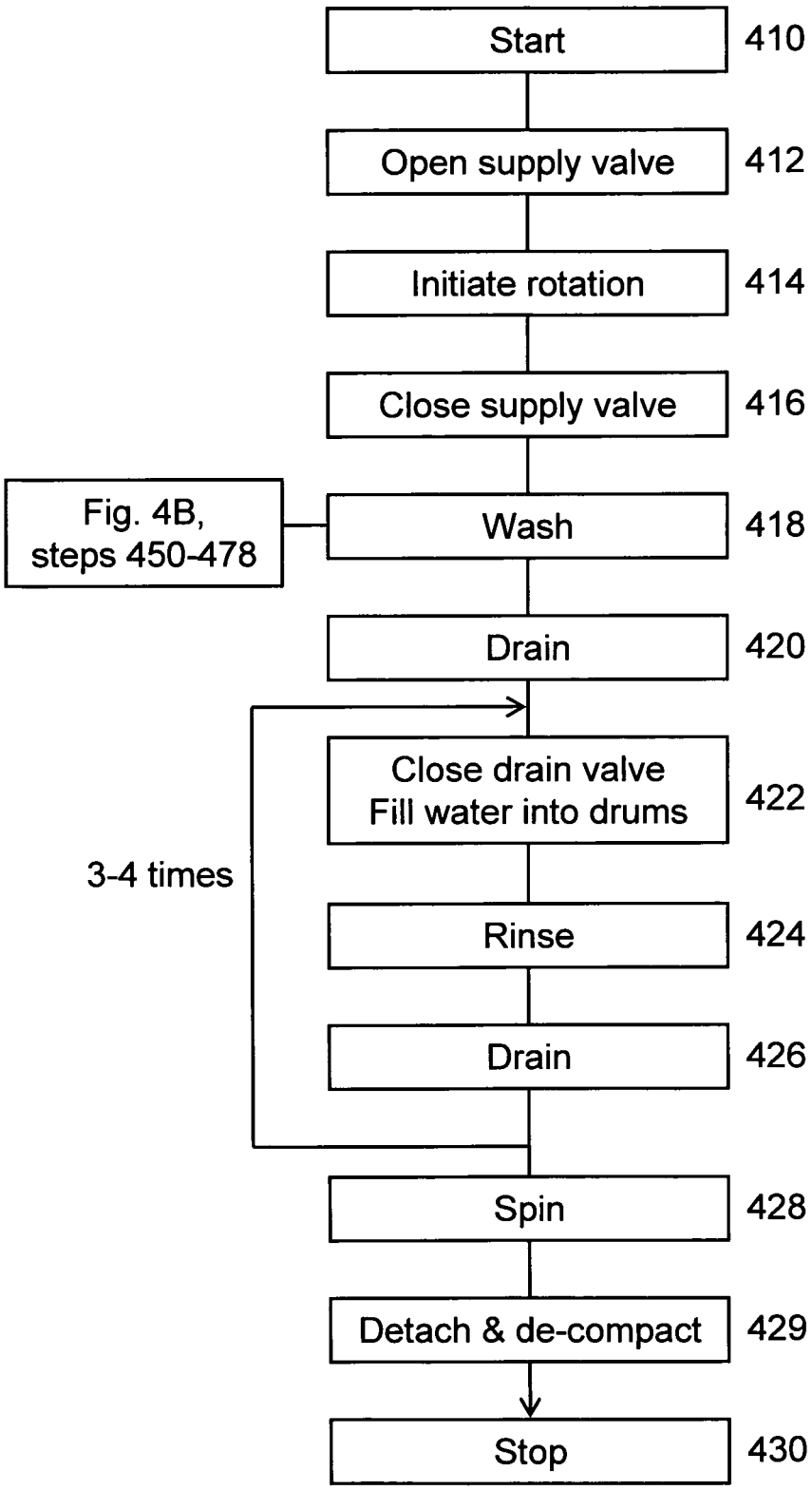
FIG. 4A is a flow chart, illustrating an embodiment of a method for controlling a washing machine.
Figure 4B:
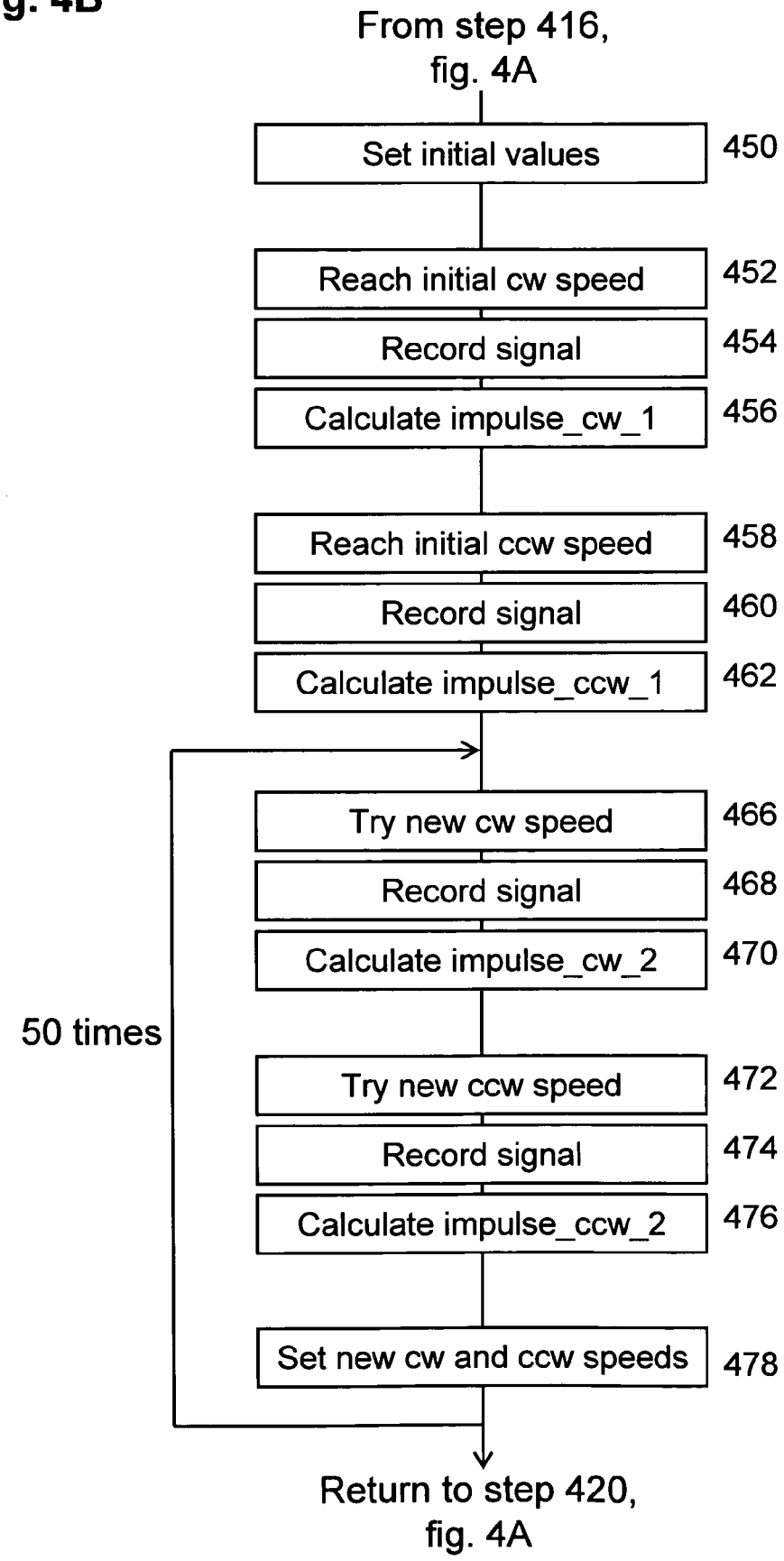
FIG. 4B is a flow chart, illustrating the washing cycle step of the method in FIG. 4A.

FIGS. 4A-B shows an example of a laundry processing method implementing one aspect of the invention. The method in this example may be implemented in e.g. the washing machine 310 shown in FIGS. 3A-B, and references are made to this washing machine where applicable. In this embodiment example, the desired process result is clean laundry. This is achieved by maximizing the mechanical action on the laundry within boundaries given by the washing program, and in particular by maximizing the value of the signal from the accelerometer 346 within corresponding boundaries.

First, the inner drum 312 of the machine 310 is loaded with a set of laundry 314 via the door 334. The amount of laundry may either be such that it does not completely fill the inner drum 312 but leaves a headspace of air above the laundry 314, or such that it completely fills the drum 312, as a headspace will anyway appear during the soaking of the laundry. The door 334 is then closed, a washing program is selected by turning the program selector 349, and the machine 310 is started upon pressing a start button.

This is the starting point 410 of the flow chart in FIG. 4A. All the subsequent steps are implemented in and controlled by the controller 340.

In step 412, the supply valve 342 is opened and water is passed, via a detergent compartment to flush detergent, into the drums 312, 320.

In step 414, a rotation of the inner drum 312 is initiated at a speed that is determined by the selected program.

In step 416, the inner drum 312 is rotated, and water and detergent is filled into the drums 312, 320, until the laundry is completely soaked and the water/detergent mixture has reached a level, which is determined by the selected program. The supply valve 342 is then closed.

In step 418, a washing cycle in which an example of one aspect of the invention is implemented, is performed according to the flow chart in FIG. 4B.

In step 420, the drums 312, 320 are drained by opening the drain valve 344 and accelerating the inner drum 312 up to a lower spin speed, determined by the selected program, to remove part of the washing fluid from the laundry 314.

In step 422, a rinsing cycle is initiated by decelerating the inner drum 312, closing the drain valve 344, and via the supply valve 342 filling water up to a rinsing level determined by the selected program.

In step 424, rinsing is performed at a rotary speed of the inner drum 312 and for a time period determined by the selected program.

In step 426 the drums 312, 320 are drained by opening the drain valve 344 and accelerating the inner drum 312 up to the lower spin speed to remove most of the water from the laundry 314.

The rinsing steps 422-426 are typically iterated 3-4 times, depending on the selected washing program.

In the spinning cycle 428, the inner drum 312 is accelerated to an upper spinning speed, determined by the selected washing program, in order to remove a desired amount of water. The laundry 314 is spun for a period of time determined by the selected washing program.

After spinning, the laundry will typically be compressed by the centrifugal force, and stuck to the inner surface of the inner drum 312.

In the detachment and de-compacting cycle 429, the inner drum 312 is decelerated to a detachment speed, at which the inner drum 314 is then slowly rotated for a time period determined by the selected washing program. The detachment speed is typically of the order a few turns per minute.

During the detachment and de-compacting cycle, the laundry is, when it passes the highest point of a drum turn, detached from the inner surface of the inner drum 312 by the force of gravity. By making the laundry move inside the drum, the laundry is also de-compacted, facilitating separation of the garments from each other and any hanging for drying.

Finally, in step 430, the inner drum 312 is stopped, whereupon the door 334 is opened and the clean laundry 314 may be removed from the drum 312.

Referring now to FIG. 4B, the washing cycle referred to in step 418 is described in greater detail.

In step 450, initial values are set using factory pre-settings in the non-volatile washing program memory 350: Clockwise and counter-clockwise wash speeds, wash_speed_cw and wash_speed_ccw, are set to default values of 50 and −50 rpm, respectively. Washing speed steps for each of the rotary directions, delta_cw and delta_ccw, are both set to 2 rpm. Maximum and minimum washing speeds, max_speed and min_speed, are set to 30 and 75 rpm, respectively. The values in the present disclosure are examples only; they are determined by the specific washing program in question.

In step 452, the inner drum 312 is accelerated until a clockwise rotary speed of wash_speed_cw has been reached.

In step 454, the inner drum 312 is kept at the speed reached in step 452 for a time period of 10 seconds, during which time period a signal from the accelerometer 346 is recorded each millisecond, and stored in positions P1-P10000 of the memory 352.

In step 456 an impulse_cw__1 value, representing a measure of a first clockwise laundry-drum interaction signal, is calculated as impulse_cw__1=max(P1 . . . P10000), and stored in the memory 352.

In step 458, the inner drum 312 is stopped, and then accelerated in the counter-clockwise direction up to wash_speed_ccw.

In step 460, the drum is kept at the speed reached in step 458 for a time period of 10 seconds, during which time period a signal from the accelerometer 346 is recorded each millisecond, and stored in positions P1-P10000 of the memory 352.

In step 462, an impulse_ccw__1 value, representing a measure of a first counter-clockwise laundry-drum interaction signal, is calculated as impulse_ccw__1=max(P1 . . . P10000), and stored in the memory 352.

In step 466 a new clockwise speed is tested. The inner drum 312 is therefore stopped, and then accelerated in the clockwise direction until a rotary speed of min(max(wash_speed_cw+delta_cw, min_speed), max_speed) has been reached.

In step 468, the inner drum 312 is kept at the speed reached in step 466 for a time period of 10 seconds, during which time period a signal from the accelerometer 346 is recorded each millisecond, and stored in positions P1-P10000 of the memory 352.

In step 470, an impulse_cw__2 value, representing a measure of a second clockwise laundry-drum interaction signal, is calculated as impulse_cw__2=max(P1 . . . P10000), and stored in the memory 352.

In step 372 a new counter-clockwise speed is tested. Therefore, the drum 312 is retarded and then accelerated in the counter-clockwise direction up to a speed of min(max(wash_speed_ccw+delta_ccw, min_speed), max_speed).

In step 474, the drum is kept at the speed reached in step 472 for a time period of 10 seconds, during which time period a signal from the accelerometer 346 is recorded each millisecond, and stored in positions P1-P10000 of the memory 352.

In step 476, an impulse_ccw__2 value, representing a measure of a second counter-clockwise laundry-drum interaction signal, is calculated as impulse_ccw__2=max(P1 . . . P10000), and stored in the memory 352.

In step 478, new improved values of wash_speed_cw and wash_speed_ccw are calculated as:

```
If impulse__cw__1 > impulse__cw__2, then
    set delta__cw to −delta__cw.
If impulse__ccw__1 > impulse__ccw__2, then
    set delta__ccw to −delta__ccw.
Set wash__speed__cw to max(min(wash__speed__cw+delta__cw,
max__speed), min__speed).
Set wash__speed__ccw to max(min(wash__speed__ccw+delta__ccw,
max__speed), min__speed).
Set impulse__cw__1 to the value of impulse__cw__2.
Set impulse__ccw__1 to the value of impulse__ccw__2.
```

The steps 466 to 478 are then repeated a number of times that is determined by the washing program; approximately 50 iterations are required for a general washing.

There are many ways to calculate a value representing a measure of the laundry-drum interaction in steps 456, 462, 470, 476. For instance, instead of finding a peak value of the acceleration as described above, also integrating the acceleration over a complete revolution of the drum 312, or over any specific time range, will yield a measure of the average mechanical action on the laundry 314. It can easily be realized that the peak value of the signal from the accelerometer 346 may be reached at a speed of the inner drum 312 that differs from the speed that maximizes the signal integrated over a complete revolution. This is because different parts of the laundry 314 may follow different trajectories inside the drum 312. All different methods of finding a maximized laundry drop height inside the inner drum 312 are within the scope of the appended claims. Equally, even though in this example an accelerometer was used, all other different methods of measuring a laundry-drum interaction signal are within the scope of the claims as well.

In the embodiment described above with reference to FIGS. 3-4, the laundry-drum interaction signal is obtained from an accelerometer. There are many other ways of obtaining such a signal. In the embodiment described in detail below with reference to FIGS. 5-6, the signal is obtained by measuring the torque delivered by the motor when rotating the drum.

EP1609901, which is hereby incorporated by reference, discloses a washing machine that is capable of obtaining an even distribution of the laundry inside a rotating drum. The purpose is to reduce oscillations, and thereby also reduce the risk of mechanical failure, during the spinning phase of the machine. EP1609901 describes how the drum may be balanced by a method making use of values of the static unbalance mass m, and an elevation torque $T_{ELEVATION}$. The present inventor has now found that the use of $T_{ELEVATION}$ and m may provide surprising benefits when used in the present invention.

$T_{ELEVATION}$ is defined as the torque needed to raise the portion of the laundry load that is not retained on the inner surface of the drum. This portion of the laundry gives a contribution to the drum torque as it is lifted by the drum, but since it does not stick to the inner surface of the drum, it does not give a corresponding contribution of opposite sign as it is falling freely on its way down (c.f. scenario A in FIG. 1 of the present disclosure).

Following the teachings of EP1609901, $T_{ELEVATION}$ and m may be calculated by measuring the motor torque $T_{MOTOR}$ and the drum angular speed ω, and using the equation described in paragraphs 31-40:

$$J_{TOTAL} \times \frac{d\omega}{dt} = -mgR \times \cos(\omega t) + T_{MOTOR} + T_{FRICTION} + F_{ELEVATION} \quad (1)$$

wherein $J_{TOTAL}$ is the total inertia of the rotating masses, comprising the laundry load, the drum, and the electric motor, with respect to the drum axis and the motor axis, respectively;

ω is the drum angular speed;

dω/dt is the drum angular acceleration;

m is the static unbalance mass of the drum and the laundry;

g is the gravity acceleration;

R is the drum radius;

−mgR*cos(ωt) is the resistant moment due to the static unbalance mass m;

$T_{MOTOR}$ is the torque provided by the electric motor and measured on the drum axis; and $T_{FRICTION}$ is the friction torque measured on the drum axis.

The equation, which is approximate, expresses the general equilibrium of the rotation of the drum.

In fact, the magnitude of $T_{ELEVATION}$ gives an indication of the length of the laundry's trajectory through the drum. An increase of $T_{ELEVATION}$ corresponds to an increase of the laundry drop height, and therefore also the mechanical action on the laundry.

If intearated over a complete period T of a turn of the drum, $$\int_0^T mgR \times \cos(\omega t)\, dt = 0$$

Further, if the drum is kept at a constant average speed, i.e., the drum speed is the same every time the drum passes a particular angle, $$\int_0^T J_{TOTAL} \times \frac{d\omega}{dt}\, dt = 0$$

or, in other words, $$\int_0^T T_{MOTOR}\, dt + \int_0^T T_{FRICTION}\, dt + \int_0^T T_{ELEVATION}\, dt = 0$$

This means that the average motor torque $T_{MOTOR}$, over an integer number of turns of the drum, gives a very good estimate of the average of the elevation torque $T_{ELEVATION}$. The contribution of $T_{FRICTION}$ may be neglected, or may be measured or estimated using any method known to those skilled in the art.

A detailed description of an example of the use of the elevation torque $T_{ELEVATION}$ is given below with reference to FIGS. 5-6.

Figure 5:
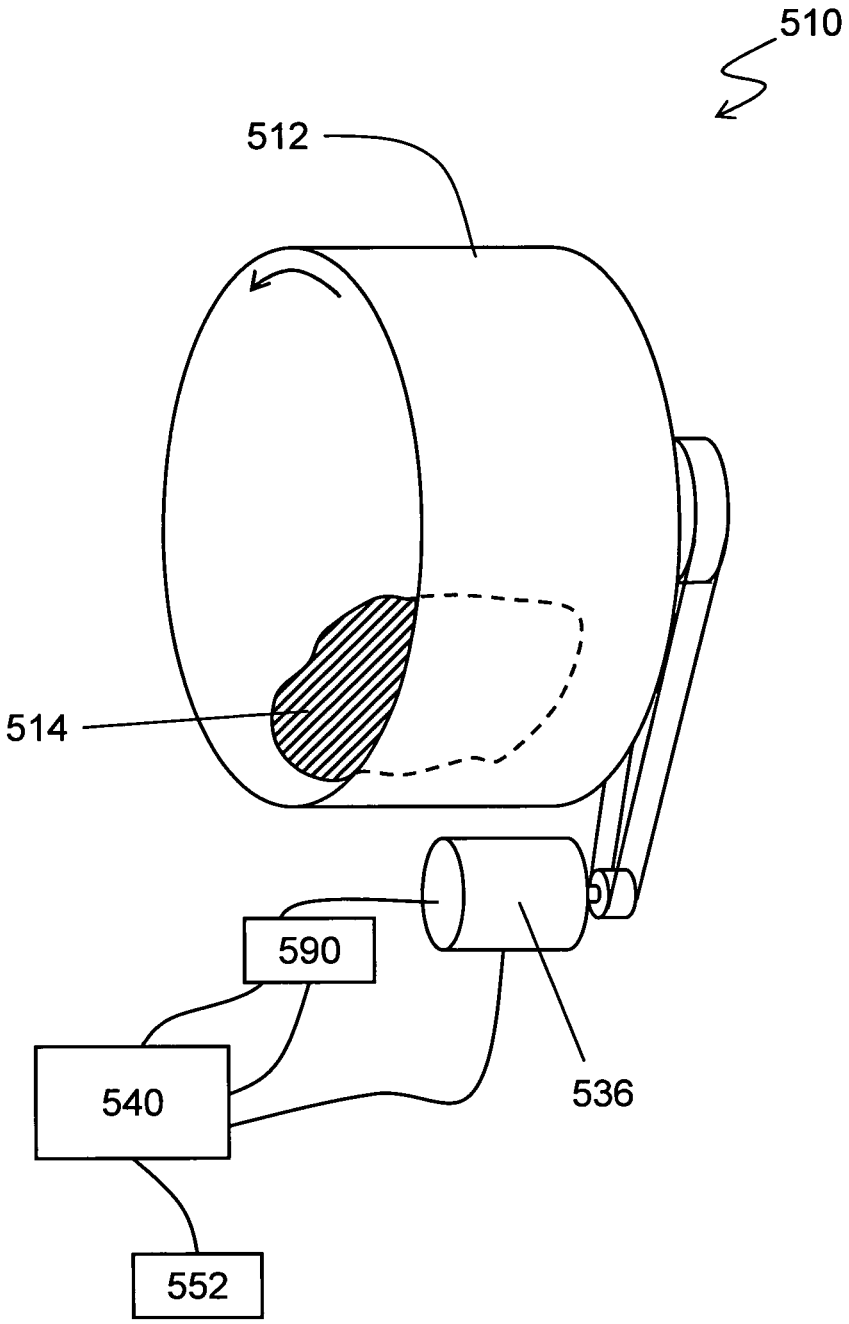
FIG. 5 is a schematic drawing of a tumble dryer.

FIG. 5 shows a tumble dryer 510, having a drum 512 comprising a set of laundry 514. The drum is arranged to be rotated by a brushless electric motor 536, which is provided with Hall effect sensors for measuring the angular position of the motor 536. The tumble dryer 510, including the motor 536, is controlled by a controller 540. The controller 540 is also connected to a memory 552 and a current sensor 590, which is arranged to measure the electrical current provided to the electric motor 536. Further, the controller 540 is arranged and configured to calculate the torque provided by the motor 536 on the basis of the signal from the current sensor 590 in a manner that is known to those skilled in the art.

Figure 6:
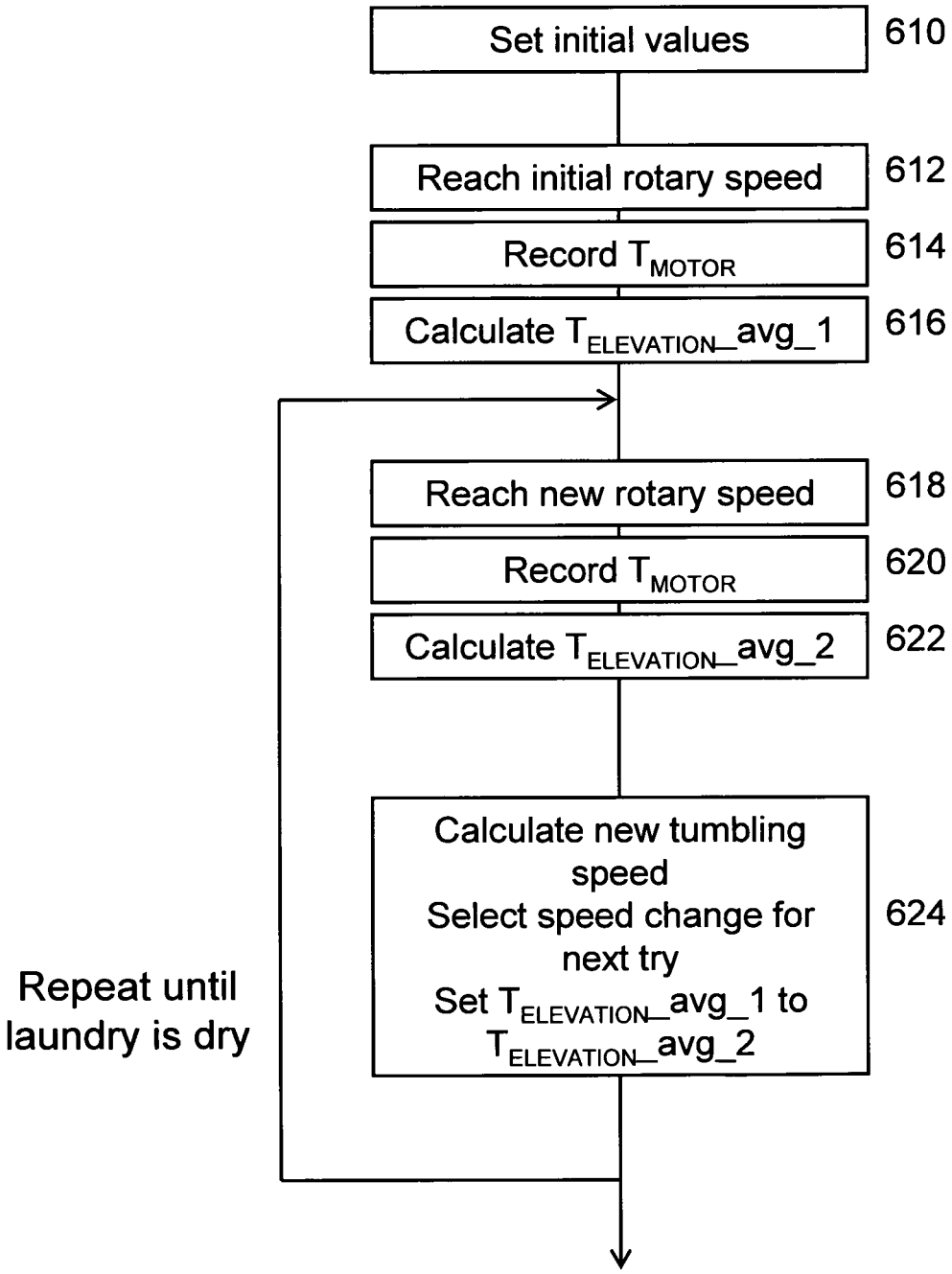
FIG. 6 is a flow chart, illustrating an embodiment of a method for controlling a tumble dryer.

FIG. 6 illustrates a laundry processing method, which may be implemented in the tumble dryer in FIG. 5 for maximizing its drying efficiency. The desired process result is thus dry laundry, and the method is performed such that the time that the laundry 514 spends falling through the air inside the drum 512 is maximized, in order to reach the desired process result as fast as possible.

First, the drum 512 of the tumble dryer is loaded with a set of laundry 514. A drying program is selected and the tumble dryer 510 is started.

In step 610, initial values are set using factory pre-settings:

The tumbling speed tumbling_speed is set to a default value of 60 rpm. The tumbling speed change step delta is set to 1 rpm. Maximum and minimum tumbling speeds, max_speed and min_speed, are set to 30 and 75 rpm, respectively. The values in the present disclosure are examples only; they are determined by the specific drying program in question.

In step 612, the drum 512 is accelerated until a rotary speed of tumbling_speed has been reached.

In step 614, the drum 512 is kept at the speed reached in step 612 for a complete revolution of the drum, as indicated by the angle reading from the Hall effect sensors of the motor 536, and for each millisecond an n:th value of $T_{MOTOR}$, $T_n$, is stored in a position $P_n$ of the memory 552, n being a sequential sample number starting from n=1.

In step 616, a first time average $T_{ELEVATION}$_avg__1, representing a measure of a first laundry-drum interaction signal, is calculated as $$T_{ELEVATION}_\text{avg}_1 = \frac{\sum_n T_n}{n}$$

and stored in the memory 552.

In step 618 a new tumbling speed is tested. The rotary speed of the drum 512 is therefore changed to min(max(tumbling_speed+delta, min_speed), max_speed).

In step 620, the drum 512 is kept at the speed reached in step 618 for a complete revolution of the drum, as indicated by the angle reading from the Hall effect sensors of the motor 536, and for each millisecond an n:th value of $T_{MOTOR}$, $T_n$, is stored in a position $P_n$ of the memory 552, n being a sequential sample number starting from n=1.

In step 622, a time average $T_{ELEVATION}$_avg__2, representing a measure of a first laundry-drum interaction signal, is calculated as $$T_{ELEVATION}_\text{avg}_2 = \frac{\sum_n T_n}{n}$$

and stored in the memory 552.

In step 624, new improved values of tumbling_speed and delta are calculated as:

---

If $T_{ELEVATION}$_avg__1 > $T_{ELEVATION}$_avg__2, then
set delta to −delta.
Set tumbling__speed to max(min(tumbling__speed +delta, max__speed), min__speed).
Set $T_{ELEVATION}$_avg__1 to the value of $T_{ELEVATION}$_avg__2.

---

The steps 618 to 624 are then repeated over and over again during the entire drying program.

It is also possible to perform the speed adjustment procedure 618-624 only in the beginning of the drying process, or at several intermittent occasions during the drying program. The starting value of $T_{ELEVATION}$_avg__1 may be determined from a factory pre-set value in step 610, or obtained using any other method than described in steps 612-616, e.g. using any estimation methods. The method described in steps 610 to 624 can also be implemented in a washing machine, or in a combined washing machine/tumble dryer.

The laundry-drum interaction signal may be any measured parameter carrying information about the length of the laundry's trajectory through the inner drum, or about the impact with which the laundry hits the bottom of the inner drum or the surface of any level of washing fluid, as the impact is strongly related to the drop height. The laundry-drum interaction signal may be based on, for example, a signal from a sensor measuring the position, velocity, or acceleration of the drum at laundry impact, a microphone or pressure sensor detecting the sound or pressure waves, respectively, emitted from the drum or any washing fluid at laundry impact, or a sensor measuring the weight of the drum, as the laundry will not contribute to the weight when falling through the drum. Further, it may be any force sensing means, such as a load cell, measuring the force with which the drum acts on the structure that supports the drum. It may also be based on a signal from the motor, e.g. a signal containing information about the torque required to drive the drum as a function of time or drum angle, since the moment of inertia of the drum depends on whether the laundry sticks to the inner surface of the drum or falls freely through the drum. Many alternative ways to detect a laundry-drum interaction signal exist; in fact, any signal comprising, in response to a rotation of the drum, information about the interaction between the laundry and the drum, or about the interaction between the laundry and any washing fluid, if present, should be regarded as laundry-drum interaction signals.

The invention is not limited to maximizing the laundry drop height or the mechanical action on the laundry; also other applications where laundry drop height or mechanical action is of importance are conceived. By way of example, wool garments and so-called delicate fabrics are fragile to excessive mechanical action on the laundry during washing and tumble-drying. As a prior art laundry processing device actually does not know to which level of mechanical action it exposes the laundry, it selects a rotary speed of the drum that yields, with a safety margin, a mechanical action that is far below the maximum tolerated level of mechanical action. As a result, the delicate fabrics program will taken longer and consume more energy than would have been required had the mechanical action part of the cleaning only been optimized. the fragility is typically accommodated for by selecting a level of mechanical action on the laundry that is well below, with a clearance, an estimated maximum tolerated level of mechanical action of wool or delicate fabrics, respectively. The level of mechanical action on the laundry is associated with the rotary speed of the drum, which is typically controlled by a wool or delicate fabrics program of a laundry processing device.

By using the present invention, it is possible to adjust the speed of the drum to reach a target level of mechanical action, without the need for a substantial safety margin due to uncertainty. And should the integrated, total amount of mechanical action during a laundry processing program reach a maximum total amount of mechanical action, it is also possible to interrupt the laundry processing program earlier.

Neither is the invention limited to controlling the mechanical action on the laundry. Also other applications in which a signal representing the interaction between the laundry and the drum is used for controlling the drum speed are conceived. By way of example, when spinning the laundry in a washing machine, the laundry is compressed and sticks to the inner surface of the inner drum. After the spinning cycle, the laundry is left as a hard, compact layer or a lump, stuck to the inner surface of the drum. Compact, attached laundry is difficult for a user to remove from the drum. Leaving the laundry in the drum overnight, e.g. when starting the washing machine before going to bed, makes it even more difficult to remove it, as it tends to stiffen with time.

State of the art washing machines therefore perform a detachment and de-compacting cycle, during which the drum is turned slowly for a while after the spinning cycle has ended. In this way, the laundry may be detached from the drum by the force of gravity when the laundry is hanging from the top of the inner surface of the drum. After detachment, the laundry is de-compacted by tumbling around inside the drum. It is however a problem that sometimes, part of the laundry is still compact and attached to the drum after the laundry program has finished. Extending the laundry detachment and de-compacting phase after the spinning will result in increased energy consumption and the user will have to wait longer for the laundry program to finish, even if all the laundry is completely detached early in the detachment phase.

By using the present invention, it is possible to detect when all laundry has been detached, and thereby assure that all the laundry is de-compacted for a period of time after the last portion of the laundry has been detached.

The invention is not limited to the specific embodiments described herein; many variations and modifications will be considered by a person skilled in the art. All those alternatives are within the scope of the appended claims.

The invention claimed is:

1. A method for controlling the processing of laundry in a laundry processing device, the device comprising a drum, adapted to accommodate laundry and being rotatably mounted on a support so as to be rotated about a substantially horizontal axis; a motor, arranged for rotating the drum, and a controller, configured to control the rotary speed of the drum, the method comprising initiating, when the drum contains laundry, a rotation of the drum by means of the motor;

recording and storing, while the laundry is being processed, a signal that is correlated to the interaction between the drum and the laundry, and that exhibits a variation caused by the rotation of the drum;

determining a speed that yields the maximum tolerated level of mechanical action on the laundry in a wool or delicate fabrics laundry processing program;

selecting a level of mechanical action on the laundry below a maximum tolerated level of mechanical action on the laundry in the wool or delicate fabrics laundry processing program;

determining a target rotary speed of the drum based on the signal correlated to the interaction between the drum and the laundry and based on the selected level of mechanical action on the laundry by keeping the target rotary speed below the speed that yields the maximum tolerated level of mechanical action on the laundry in the wool or delicate fabrics laundry processing program; and adjusting the rotary speed of the drum to the target rotary speed, wherein the signal that is correlated to the interaction between the drum and the laundry is determined on the basis of impact acceleration of the drum or of any structure connected to the drum as the laundry hits the bottom inner surface of the drum or the force exerted by the drum on any structure supporting the drum.

2. The method according to claim 1, wherein the target rotary speed is within a rotary speed interval of from 75% to 120% of a rotary speed that corresponds to a maximum of the laundry drop height.

3. The method according to claim 1, wherein the laundry processing device further comprises a drain valve; and the method is performed while the drain valve is closed and the drum contains a level of washing fluid.

4. The method according to claim 1, wherein the signal is correlated to at least one of the following: the movement of the laundry inside the drum; the static unbalance mass of the drum and the laundry.

5. The method according to claim 1, wherein the laundry processing device is a tumble dryer.

6. The method according to claim 1, wherein the signal that is correlated to the interaction between the drum and the laundry is determined on the basis of at least one of the following: the location, velocity, or the elevation torque; the weight of the drum; the signal from a camera, a pressure sensor, or a microphone.

* * * * *